United States Patent [19]

Kasai

[11] Patent Number: 4,704,772

[45] Date of Patent: Nov. 10, 1987

[54] SNAP-FIT CLASP FASTENER FOR BAGS

[75] Inventor: Kazumi Kasai, Namerikawa, Japan

[73] Assignee: Yoshida Kogyo K.K., Tokyo, Japan

[21] Appl. No.: 924,972

[22] Filed: Oct. 30, 1986

[30] Foreign Application Priority Data

Nov. 2, 1985 [JP] Japan ..... 60-169682[U]

[51] Int. Cl.[4] ..... A44B 17/00

[52] U.S. Cl. ..... 24/669; 24/682

[58] Field of Search ..... 24/580, 581, 582, 583, 24/584, 669, 670, 625, 662, 702, 682

[56] References Cited

U.S. PATENT DOCUMENTS

| | | | |
|---|---|---|---|
| 567,198 | 9/1896 | Richardson | 27/670 |
| 710,123 | 9/1902 | Stearn | 24/582 X |
| 1,507,216 | 9/1924 | Stockton | 24/581 |
| 2,999,125 | 9/1961 | Young | 24/669 X |
| 3,296,667 | 1/1967 | Streule et al. | 24/581 X |
| 3,512,226 | 5/1970 | Carlile | 24/669 |

*Primary Examiner*—Kenneth J. Dorner
*Assistant Examiner*—James R. Brittain
*Attorney, Agent, or Firm*—Hill, Van Santen, Steadman & Simpson

[57] ABSTRACT

A snap-fit clasp fastener includes a catch member and a reel-shaped retainer member releasably couplable to connect portions of a bag to close an opening in the bag. The catch member includes a body having an underside engageable with one portion of the bag, a pair of resiliently flexible legs projecting from one end of the body in a common direction, and a grip head extending from an opposite end of the body in parallel with the legs. The resilient legs have a pair of confronting arcuate recessed portions, respectively, for snappingly receiving therein a cylindrical retaining portion of the retainer member to lock the catch and retainer members in coupled condition. The grip head is spaced a distance from the underside of the body for easy and stable manipulation of the catch member.

3 Claims, 10 Drawing Figures

SNAP-FIT CLASP FASTENER FOR BAGS

BACKGROUND OF THE INVENTION

1. Field of the Invention

The present invention relates to a snap-fit clasp fastener for closing an opening in a bag, such as a handbag, briefcase or the like.

2. Prior Art

Japanese Utility Model Laid-open Publication No. 48-18596 discloses, as reillustrated here in FIGS. 8–10, a snap-fit clasp fastener including a plug member A and a socket member B adapted to be releasably coupled together to close an opening in a bag. The plug member A includes a pair of parallel cantilevered resilient legs C, C and the socket member B includes a hollow body D into which the legs C are frictionally inserted until feet E, E on the respective legs C are snapped into engagement with a locking end edge F of the socket body D to thereby lock the plug and socket members A, B in coupled condition. The plug member A further includes a planar body G integral with the legs C and attached flatwise to a flap H of the bag for manipulation of the plug member A.

The disclosed clasp fastener thus constructed is however disadvantageous in that the hollow socket member B is relatively complicated in construction and hence is costly to manufacture. Furthermore, the planar plug body G is relatively thin so that a firm and stable gripping of the plug member A is difficult to achieve. With this construction, coupling and uncoupling operation of the clasp fastener becomes tedious and time-consuming.

SUMMARY OF THE INVENTION

It is accordingly an object of the present invention to provide a snap-fit clasp fastener for bags which is simple in construction and hence can be manufactured at a low cost and which is capable of being coupled and uncoupled with utmost ease.

According to the present invention, a snap-fit clasp fastener includes a catch member and a reel-shaped retainer member releasably couplable to connect portions of a bag to close an opening in the bag. The catch member includes a body having an underside engageable with one portion of the bag, a pair of resiliently flexible legs projecting from one end of the body in a common direction, and a grip head extending from an opposite end of the body in parallel with the legs. The resilient legs have a pair of confronting arcuate recessed portions, respectively, for snappingly receiving therein a cylindrical retaining portion of the retainer member to lock the catch and retainer members in coupled condition. The grip head is spaced a distance from the underside of the body for easy and stable manipulation of the catch member.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 5:
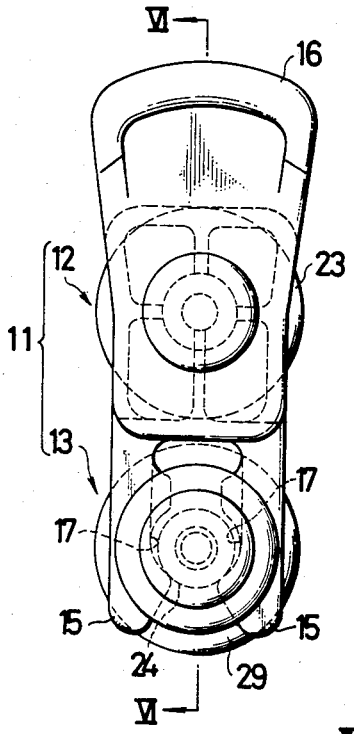
FIG. 5 is a plan view of the catch and retainer members of the snap-fit clasp fastener shown engaged or connected.

The present invention is particularly useful when embodied in a snap-fit clasp fastener such as shown in FIG. 5, generally indicated by the reference numeral 11.

The clasp fastener 11 comprises a catch member 12 and a retainer member 13 releasably coupled with the catch member 12. Both members 12, 13 are molded of rigid synthetic resin.

Figure 1:
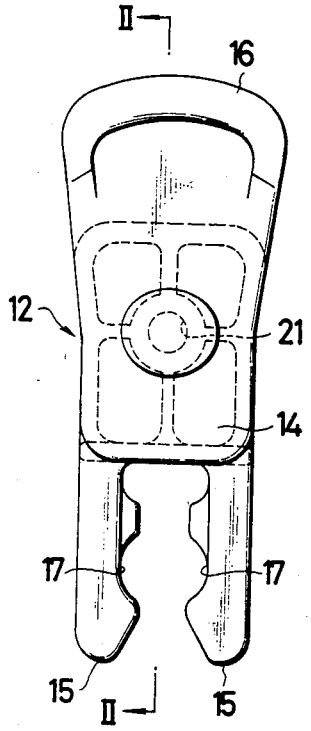
FIG. 1 is a plan view of a catch member which constitutes one part of a snap-fit clasp fastener embodying the present invention.
Figure 2:
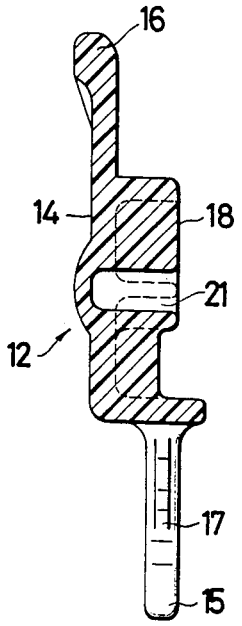
FIG. 2 is a cross-sectional view taken along line II—II of FIG. 1.
Figure 6:
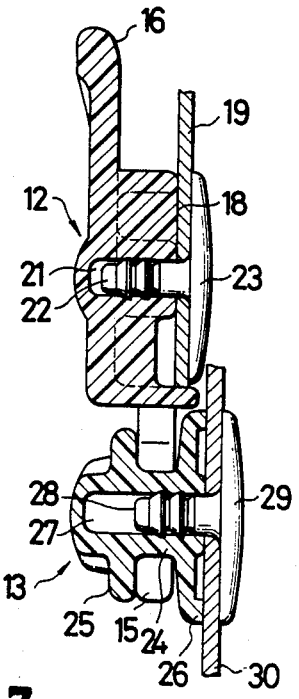
FIG. 6 is a cross-sectional view taken along line VI—VI of FIG. 5.
Figure 7:
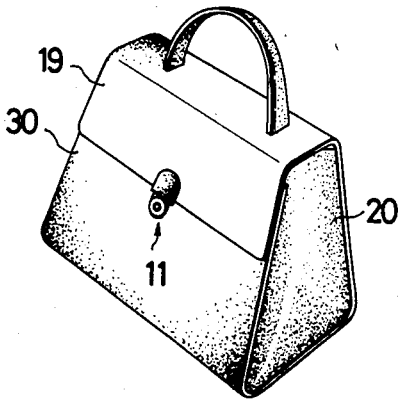
FIG. 7 is a schematic perspective view of a handbag on which the snap-fit clasp fastener is employed.
Figure 8:
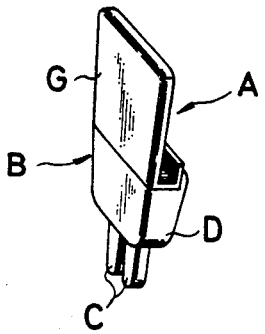
FIG. 8 PRIOR ART
FIG. 8 is a schematic perspective view of a known snap-fit clasp fastener.
Figure 9:
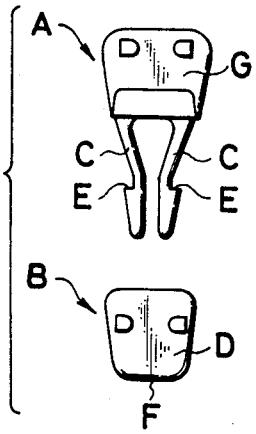
FIG. 9 PRIOR ART
FIG. 9 is a schematic bottom view of a plug member and a socket member of the clasp fastener shown in FIG. 8.
Figure 10:
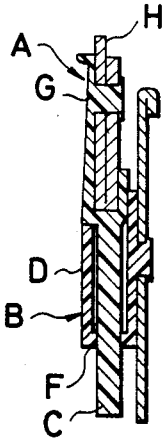
FIG. 10 PRIOR ART
FIG. 10 is an enlarged longitudinal cross-sectional view of the known clasp fastener shown in engaged or closing condition.

As better shown in FIGS. 1 and 2, the catch member 12 comprises an integral molded construction composed of a generally rectangular body 14, a pair of parallel cantilevered legs 15, 15 extending from one end of the body 14 in a common direction, and a tongue-like grip head 16 extending from the opposite end of the body 14 in parallel with the cantilevered legs 15. The legs 15 are thinner than the body 14 so that they are elastically deformable when stressed but are capable of springing back to their unstressed initial position when released. The legs 15 have a pair of confronting arcuate recessed portions 17, 17, respectively, for a purpose described below. The grip head 16 is also thinner than the body 14 and is disposed adjacent to a front side of the body 14 which is remote from a back or underside 18 of the body 14. In use the catch member 12 is attached to a flap 19 of a handbag 20 (FIG. 7) with the underside 18 lying flatwise against the flap 19, as shown in FIG. 6. In this condition, the grip head 16 and the flap 19 define therebetween a space into which a finger of the user is insertable. With the space thus provided, the user can readily and firmly grip the grip head 16, thus making it possible to manipulate the catch member 12 stably with utmost ease. The body 14 includes a central blind hole 21 opening to the underside 18 thereof for firmly receiving therein a shank 22 of a tack member 23 when the shank 22 is forced through the flap 19 into the hole 21 to attach the catch member 12 to the flap 19 of the handbag 20.

Figure 3:
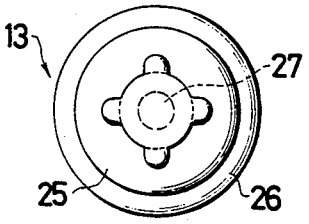
FIG. 3 is a plan view of a retainer member which constitutes the other part of the snap-fit clasp fastener.
Figure 4:
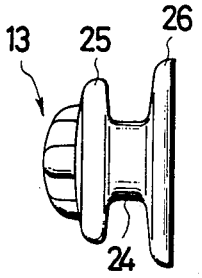
FIG. 4 is a side view of FIG. 3.

The retainer member 13 is in the shape of a reel or spool, as shown in FIG. 4, and it includes a central cylindrical retaining portion 24 and upper and lower annular flanges 25, 26 on opposite ends of the retaining portion 24. The retaining portion 24 has an outside diameter slightly smaller than the diameter of a circle which is commonly defined by the recessed portions 17 of the respective legs 15. The upper flange 25 has on its front face an ornamental design pattern, as shown in FIG. 3. The retainer member 13 further has an axial blind hole 27 opening to an underside of the lower flange 26 for firmly receiving a shank 28 of a tack member 29 when the shank 28 is forced through a face plate 30 of the handbag 20 to attach the retainer member 13 to the face plate 30, as shown in FIG. 6. The reel-shaped retainer member 13 is simple in construction and hence can be manufactured less costly.

To couple the catch and retainer members 12, 13 of the clasp fastener 11 as shown in FIGS. 5 and 6, the grip head 16 of the catch member 12 is gripped by user's fingers and then the catch member 12 is pushed toward the retainer member 12 to force the resilient legs 15 onto the cylindrical retaining portion 24 of the retainer member 13. In this instance, an outer peripheral wall of the retaining portion 24 is brought into frictional engagement with the opposed inner sidewalls or feet of the legs 15, whereupon the legs 15 are urged to flex resiliently away from each other. Further advancing of the legs 15 causes the feet of the legs 15 to move past an imaginary axial central plane of the retaining portion 24, whereupon the retaining portion 24 is snapped into the recessed portions 17 as the resilient legs 15 spring back to their original position illustrated in FIGS. 5 and 6. In this position, the legs 15 are retained on the retaining portion 14, thereby locking the catch and retainer members 12, 13 in coupled condition. The upper flange 25 of the retainer member 13 prevents the legs 15 from displacing off the retainer member 13 in the axial direction thereof.

To disengage the catch and retainer members 12, 13, the grip head 16 is pulled by the users fingers against the resiliency of the legs 15. When at least a lower half of the cylindrical retaining portion 24 moves outside the recessed portions 17, the legs 15 are thrusted away from the retaining portion 24 by the resilient forces stored therein.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A snap-fit clasp fastener for releasably connecting first and second portions of a bag for closing an opening in the bag, said clasp fastener comprising:

(a) a catch member molded of a synthetic resin and adapted to be mounted on the first portion of the bag, said catch member including a body having an underside engageable with the first portion, a pair of resiliently flexible legs projecting from an end of said body in a common direction and having a pair of confronting arcuate recessed portions, respectively, and a grip head extending from an opposite end of said body in parallel with said legs, said grip head being thinner than said body and spaced from said underside of said body; and (b) a retainer member molded of synthetic resin, adapted to be mounted on the second portion of the bag and releasably couplable with said catch member, said retainer member including a cylindrical retaining portion snappingly receivable into said recessed portions, and a pair of flanges on opposite ends of said retaining portion.

2. A snap-fit clasp fastener according to claim 1, said grip head being disposed adjacent to a front face of said body.

3. A snap-fit clasp fastener according to claim 1, said body having a central blind hole opening to said underside, said retainer member having an axial central blind hole opening to one of said flanges, further including a first tack member having a first shank receivable in force fit in said blind hole in said body to attach the catch member to the first portion of the bag, and a second tack member having a second shank receivable in force fit in said axial blind hole in said retainer member to attach the latter to the second portion of the bag.

* * * * *